US007142954B2

(12) United States Patent
Neiser

(10) Patent No.: US 7,142,954 B2
(45) Date of Patent: Nov. 28, 2006

(54) MODEL TRAIN CONTROLLER INTERFACE DEVICE

(76) Inventor: Robert C. Neiser, 6560 Malbrook Ct., Manassas, VA (US) 20112

( * ) Notice: Subject to any disclaimer, the term of this patent is extended or adjusted under 35 U.S.C. 154(b) by 87 days.

(21) Appl. No.: 10/865,932

(22) Filed: Jun. 14, 2004

(65) Prior Publication Data

US 2005/0278086 A1 Dec. 15, 2005

(51) Int. Cl.
*A63H 19/24* (2006.01)

(52) U.S. Cl. ..... 701/19; 105/1.5

(58) Field of Classification Search ..... None
See application file for complete search history.

(56) References Cited

U.S. PATENT DOCUMENTS 6,065,406 A 5/2000 Katzer
6,441,570 B1 8/2002 Grubba et al.
6,457,681 B1 10/2002 Wolf et al.
6,624,537 B1 9/2003 Westlake
6,655,640 B1 12/2003 Wolf et al.

OTHER PUBLICATIONS

Technology for Model Train 1999; Uhlenbrock Elektronik; Product Brochure (www.uhlenbrock.de).*
rec.models.railroad FAQ;http://www.spikesys.com; Jan. 5, 2002: What is Lionel's Trainmaster System?; What is MTH's Digital Command System?.*

* cited by examiner

*Primary Examiner*—Michael J. Zanelli
(74) *Attorney, Agent, or Firm*—Richard C. Litman

(57) ABSTRACT

The model train controller interface device provides a user with the capability of operating model train engine, switch and accessories of one manufacturer with the handheld wireless device of a second manufacturer. Inserted between the command base units and controller devices of different model train manufacturers, the interface device allows the wireless remote of one train system to operate components of the other train system without loss of functionality by either model train system.

6 Claims, 8 Drawing Sheets

MODEL TRAIN CONTROLLER INTERFACE DEVICE

BACKGROUND OF THE INVENTION

1. Field of the Invention

The present invention relates to control systems for model trains, and particularly to devices that interface between control systems of different model train manufacturers, allowing one vendor's control unit to operate components of a competing manufacturer.

2. Description of the Related Art

Model train control systems have, as basic building blocks, a set of interconnected sections of train track, electric switches between different sections of the train track, a variety of electrically controlled devices, and finally, at least one electric train engine.

Standard O-gauge electrical train operation is characterized by an AC track signal, wherein the AC signal is switchably offset by a DC signal used to enable various train accessories such as the horn/whistle function. The AC track signal energizes the electric motor of the train engine, with the DC offset enabling a train engine relay unit to activate the appropriate bell or whistle feature. In addition, certain standard O-gauge type transformers include fixed AC voltage supply terminals for operating lights and additional accessories.

In order to ensure compatibility of their products and accessories with those already in use, current manufacturers have adhered to the basic electrical standard, namely the AC track signal voltage and DC control offset popularized by the standard O-gauge transformer. The standardization of this power arrangement ensures the continued compatibility of vintage train engines with new engines and other model train technologies.

The vintage train engines utilize a transformer with a variable output voltage controls the speed of the engine by directly controlling the voltage applied to the track; the greater the voltage, the greater the speed.

In newer engines digital control systems are employed in which a set voltage is applied to the track and the train responds to command signals from a command unit that transmits signals to the train. There are several manufacturers of both the vintage and command signal model train methodologies, and within the command system category of model trains, different manufacturers employ different command signals for the control of their engines.

One example of the legacy control system includes U.S. Pat. No. 6,624,537, issued to Richard Westlake in September 2003. The '537 patent discloses a plural output control station having a data processor for monitoring and controlling the signals generated at a plurality of transformer-driven power output terminals. The variable-voltage outputs are controlled by a data processor, which responds to respective operator-controlled throttles for varying the AC output voltage and therefore the rate of movement and direction of electric train engines.

Digital model-railway control systems have been state-of-the-art for several years. In such control systems the full driving voltage, e.g. 16 volts AC, is continually applied to the track. The rails serve simultaneously to transmit digital data, forming a so-called data bus. For this purpose, appropriate digital control commands are superimposed on the driving voltage and include commands specifying direction, velocity and ancillary functions, such as activation of lights or automatic coupling. These digital control commands are encoded by a control system in a digital transmission format, e.g. NMRA/DCC, with address information designating a particular engine. Each engine has a decoder for picking out its commands. Such decoders can also be used in other functional articles such as cranes, switches or the like, for the remote triggering of control commands. Model train systems incorporating digital control systems include Train-Master Command Control (TMCC) from Lionel Trains, Inc. and the DCS from Mike's Train House (MTH).

The Lionel TMCC, for instance, utilizes a wireless control unit (CAB), which transmits a signal to the TMCC base, which in turn, modulates a 455 KHz carrier signal. The FM modulated signal is then capacitor coupled to the common of the track system. An FM receiver in the engine detects the modulated signal and performs the required function. The TMCC also controls the operation of track switches and other devices by means of Accessory Switch Controllers (ACS). The TMCC transmits a digital signal to the ASC containing command information along with an address field. Each ASC has an unique address which responds to the address transmitted by the TMCC. Upon command from the Lionel wireless control unit (CAB), an ASC can operate eight accessories or four switches and ten train routes. In addition to receiving commands from the wireless digital controller, the TMCC has a port for receiving digital signals from a user provided digital device such as a computer.

An alternative control system for model trains is provided by Mike's Train House Inc. (MTH) DCS, which is based upon U.S. Pat. Nos. 6,457,681 and 6,655,640, issued to Wolf et al. in October 2002 and December 2003 respectively. The '681 patent discloses a handheld remote control unit through which various commands may be entered to control not only the train engine, but also track switches and ancillary electric devices. A Track Interface Unit (TIU), in RF communication with the handheld controller, converts the commands to a modulated signal and transmits control signals to the engine over the power rail of the track system. The control signal is not a wireless FM signal and requires electrical connectively between the train and the track. The train picks up the modulated signal, retrieves the entered command, and executes it through use of a processor and associated circuitry onboard the engine.

As with the TMCC, the MTH DCS permits remote control of track switches and accessories by the use of a TIU connected Accessory Interface Unit (AIU), which has a set of output relays that are coupled to various portions of the track layout through standard hard wiring.

The AIU is electrically connected to the TIU by a variety of electrical means and operates the various accessories in response to user commands initiated by the handheld unit. Because of their popularity most of the O-gauge world runs TMCC and DCS and many model train enthusiasts have both systems and may want to control their TMCC trains using their MTH handheld remote Both the Lionel TMCC and the MTH TIU have serial data ports that once connected allow for limited interoperability between the two competing systems. In order to do this, a serial data cable must be connected between the MTH TIU and the Lionel TMCC, and the MTH TIU must then be programmed to transmit Lionel train commands over the serial interface to the TMCC. However, as noted, the interface is limited. DCS can control TMCC but TMCC cannot control DCS. Furthermore, the TMCC command base port to which the TMCC-TIU cable is connected is the same port used to connect to the TMCC ASCs. Therefore, the use of the TMCC-TIU cable precludes the use of the TMCC ASC devices, and for all intents and purposes, renders the CAB-1 hand held remote ineffective to control TMCC accessories through TMCC ASC devices.

MTH DCS and TMCC are not the only model train control systems that have been developed. Other systems have been disclosed in U.S. Pat. No. 6,065,406, issued to M. Katzer in May 2000, and U.S. Pat. No. 6,441,570, issued to Grubba et al. in August 2002.

None of the above inventions and patents, taken either singly or in combination, is seen to describe the instant invention as claimed. Thus, a model train controller interface capable of interfacing disparate model train systems is desired.

SUMMARY OF THE INVENTION

The model train interface device provides a user with the capability of operating model train engines, switches and accessories of one manufacturer with the handheld wireless device of a second manufacturer. Inserted between the Track Interface Unit (TIU) supplied by Mike's Train House (MTH) and the TrainMaster Command Control (TMCC) command base station manufactured by Lionel, Inc., the interface allows the MTH hand held remote to control TMCC devices without limiting the functionality of the TMCC wireless controller. The interface converts the signals from the TIU to the TMCC protocol and transmits them to the TMCC base station. The TMCC base station then transmits engine commands to the locomotives or echoes switch and accessory commands to Accessory Switch Controllers through the interface.

Unlike simple serial cable interfaces which permits a DCS handheld control device to operate TMCC equipped trains at the price of rendering useless TMCC switch and accessory control components, embodiments of the present invention do not limit functionality of the TMCC components.

The model train interface device comprises three embodiments. The first embodiment comprises a housing, which includes a printed circuit board, a plurality of connectors in electrical communication with a first train controller device, a second train controller device, and at least one train accessory controller device. The device receives AC power from a transformer or the train track and produces an operative voltage to the electronic circuitry contained within the housing.

The printed circuit board contains electronic circuitry that controls the flow of data between the interconnected devices. The circuitry includes a microcontroller with memory, interface logic and program instruction code stored within the memory. The microcontroller controls the flow of commands from the MTH TIU to the TMCC command base. Furthermore, the microcontroller accepts commands received from any other source of TMCC commands, such as the action Recorder Controller (ARC) and multiplexes these commands over the data link to the TMCC command base.

The second embodiment is an interface cable having two connectors disposed on either cable end, and includes a pigtail having at least two leads extends from one of the cable connectors and is adapted for attachment to terminal leads disposed on the switch and accessory device controllers. Designed to operate in combination with the commercially available TIU/TMCC serial cable, the present invention allows MTH DCS wireless controls to command TMCC equipped engines, while retaining the ability of the TMCC remote handheld to command TMCC equipped switch and accessory controller devices.

A third embodiment, similar to the interface cable of the second embodiment, connects directly to the TIU and is designed to eliminate the need of the prior art TIU/TMCC serial cable.

These and other features of the present invention will be apparent upon consideration of the following specification and drawings.

BRIEF DESCRIPTION OF THE DRAWINGS

Similar reference characters denote corresponding features consistent throughout the attached drawings.

DETAILED DESCRIPTION OF THE PREFERRED EMBODIMENT

Figure 1:
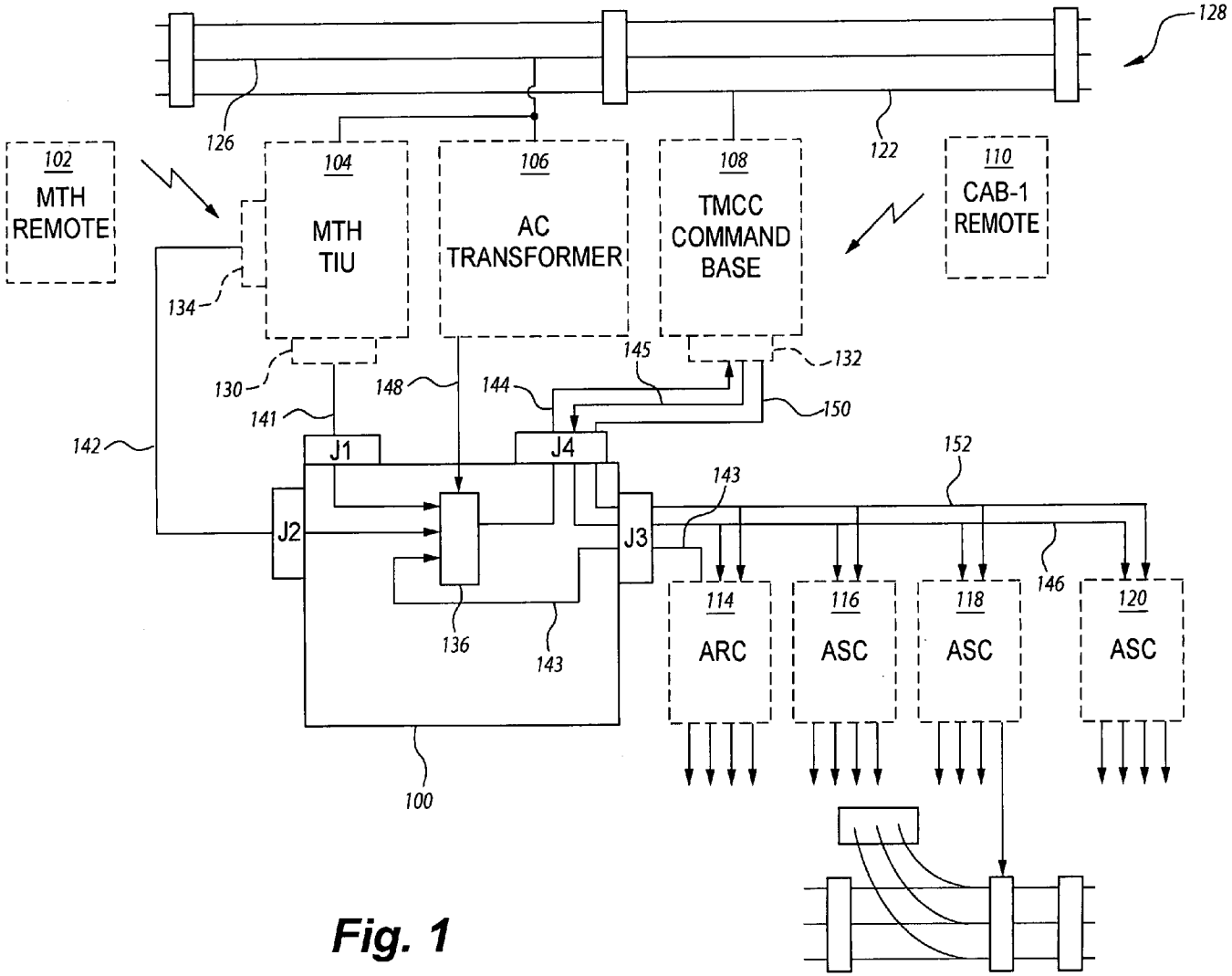
FIG. 1 is a block diagram illustrating a model train controller interface device according to the present invention interconnecting a MTH TIU with a TMCC command base.

The present invention is a model train controller interface device, designated generally as 100 in the drawings, that allows communication between components of Mikes Train House (MTH) DCS model train system and model train systems incorporating TrainMaster Command Control (TMCC) developed by Lionel, Inc.

Figure 2A:
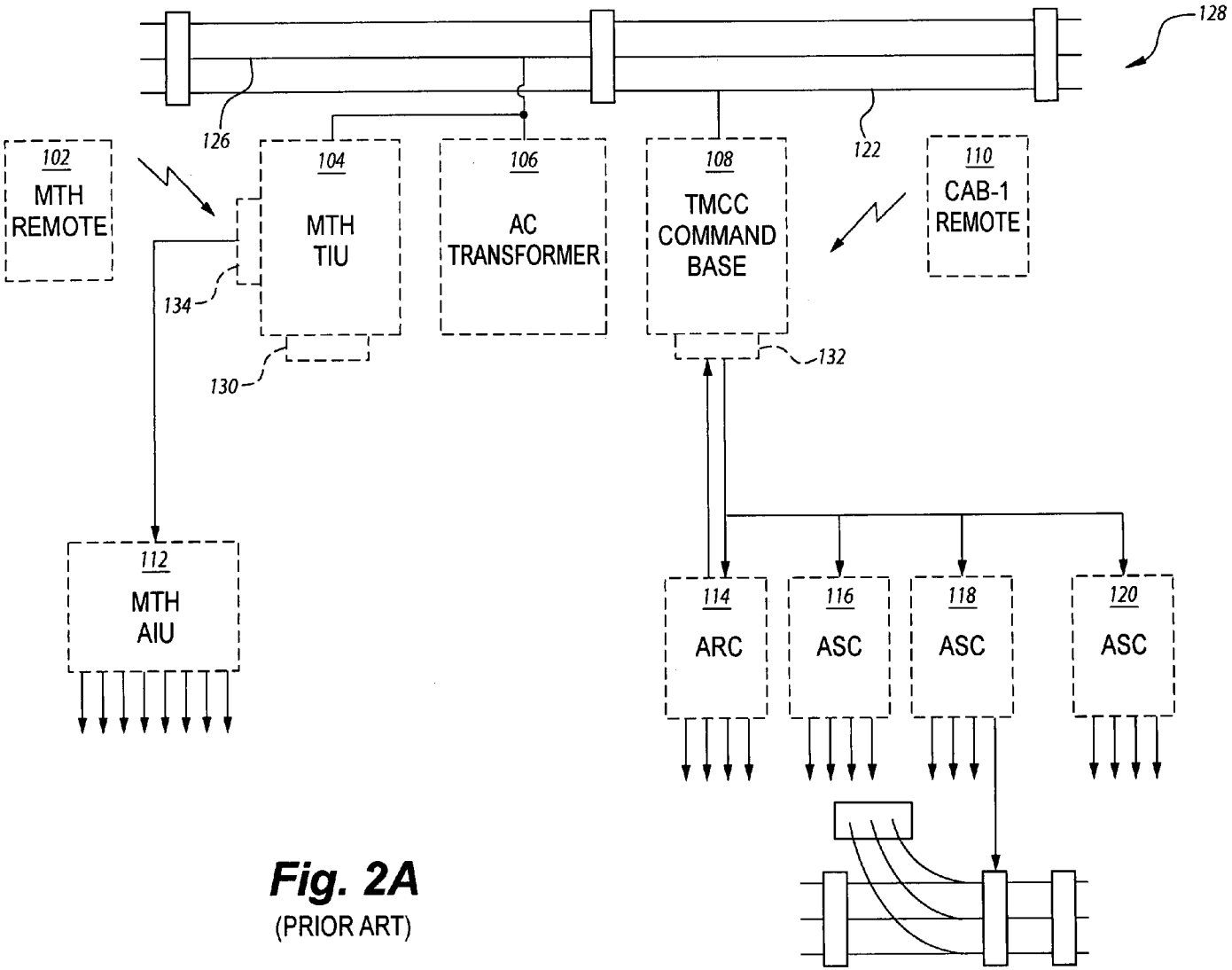
Fig. 2A (PRIOR ART)
FIG. 2A is a block diagram of the prior art illustrating a track layout incorporating MTH DCS and TMCC equipped but non-communicating model train components.

FIG. 1 represents a block diagram of a first embodiment of the present invention 100 incorporated in a model train layout having both TMCC and Mike's Train House (MTH) model train components. FIG. 2A represents prior art and illustrates a train layout in which the MTH model train components provide no commands to TMCC equipped components. In other words, the MTH handheld wireless device 102 can control only MTH engines and devices connected to the Accessory Interface unit (AIU) 112. Likewise, the CAB-1 remote 110 can control only TMCC engines and TMCC controllers, such as Accessory Switch Controllers (ASC) 116–120 and the Action Recorder Controller (ARC) 114.

Figure 2B:
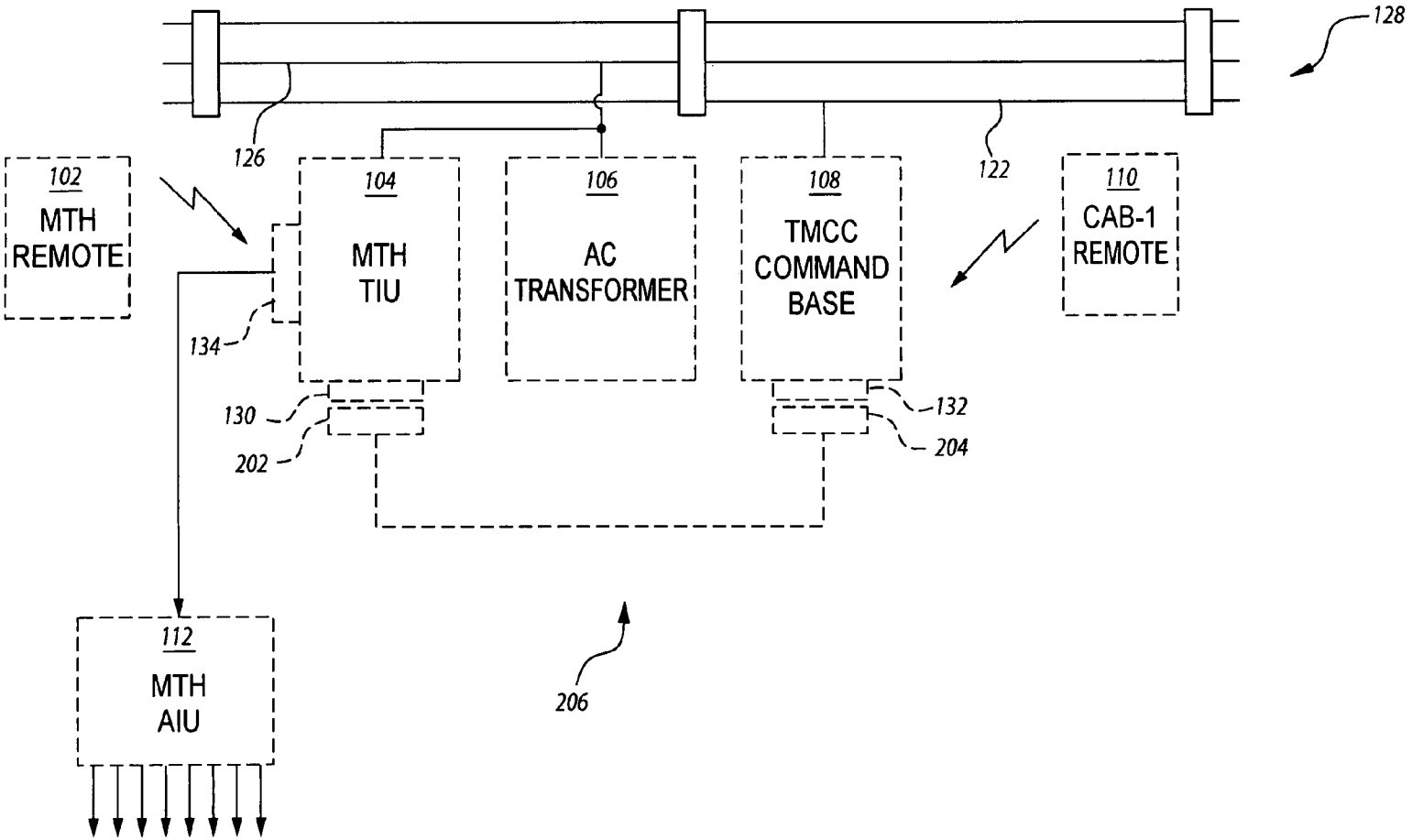
Fig. 2B (PRIOR ART)
FIG. 2B is a block diagram of the prior art illustrating a model train layout having the MTH TIU and the TMCC command base connected by a TIU/TMCC serial cable.

Still illustrating the prior art, FIG. 2B represents an alternate track layout in which the MTH TIU 104 and the TMCC command base 108 are interconnected by a TIU/TMCC serial cable 206 having female and male 9-pin connectors 202, 204 connected between TIU 104 port 130 and TMCC base command unit 108 port 132 respectively. Implementing the TIU/TMCC cable 206 allows a DCS handheld wireless device 102 to command TMCC equipped engines and precludes the use of the TMCC controller devices 114–120 which must be connected to the same port, that is TMCC base command unit 108 port 132.

Referring back to FIG. 2A, a model train layout utilizing the TMCC system requires, at a minimum, a CAB-1 remote control 110, which is used by the operator to control all model train functions, and a TMCC command base 108. The command base 108 receives signals from the CAB-1 110 and relays them to TMCC controllers 114–120. The command base 108 relays signals to the layout in two ways. The first way uses radio waves, so that signals to engines are carried along the outside rail 122 of the layout. This requires a single wire connecting the command base 108 to an outside rail 122 of the track 128 or a transformer's common or U terminal. Engines, placed on the track, pick up the signals independent of their location on the track 128. The second means by which the TMCC command base 108 communicates is via an asynchronous data link that uses 2 wires connected to a serial port 132 integrated in the command base. Port 132 of the command base 108 echoes on its transmit lead all commands received from the CAB-1 110. In addition to echoing signals received from the CAB-1 110, the transmit lead on port 132 echoes back all commands received on the receive lead of port 132 after being processed by the command base 108. The wires carrying the command signals can be daisy-chained from one TMCC device to another, so a layout that uses multiple TMCC equipped controllers only needs to have one pair of wires connected to the command base 108. One such controller for controlling up to 4 switches or up to 8 accessories is the Accessory Switch Controller (ASC) 116–120. An Action Recorder Controller (ARC) 114 is also available, which records whatever commands are generated by the CAB-1 remote 110, storing them for future playback.

The data link between port 132 and the TMCC controllers 114–120 transmits and receives signals utilizing a 9600-baud, one stop bit, and no parity protocol. The data is transmitted in a three-byte format, the first eight-bit byte being hexadecimal "FE". The remaining two bytes, as shown in Table 1, consists of address and data bits, whereby the CAB-1 handheld remote 110 can transmit switch commands, route commands, engine commands, train commands, accessory commands and group commands.

Table 2 represents the command set the command base 108 uses to communicate with the ASCs for controlling routes. Table 3 represents the command set that the TMCC 108 sends to the ASCs 116–120 for controlling track switches, and Table 4 represents the commands sent by the command base 108 to the ASCs for controlling accessories.

TABLE 1

TMCC Command Base General Command Format

| | Bit Order | | | | | | | | | | | | | | | |
|---|---|---|---|---|---|---|---|---|---|---|---|---|---|---|---|---|
| | MSB 15 | 14 | 13 | 12 | 11 | 10 | 9 | 8 | 7 | 6 | 5 | 4 | 3 | 2 | 1 | LSB 0 |
| Switch Commands | 0 | 1 | A | A | A | A | A | A | A | C | C | D | D | D | D | D |
| Route commands | 1 | 1 | 0 | 1 | A | A | A | A | A | C | C | D | D | D | D | D |
| Engine Commands | 0 | 0 | A | A | A | A | A | A | A | C | C | D | D | D | D | D |
| Train Commands | 1 | 1 | 0 | 0 | 1 | A | A | A | A | C | C | D | D | D | D | D |
| Group Commands | 1 | 1 | 0 | 0 | 0 | A | A | A | A | C | C | D | D | D | D | D |
| Accessory Commands | 1 | 0 | A | A | A | A | A | A | A | C | C | D | D | D | D | D |

Definitions
A—Address field
D—Date Field
C—Command Field:
00 - action
01 - Extended
10 - Relative speed
11 - Absolute speed

TABLE 2

TMCC Route Commands

| Route Commands | Command field | | | Data Field | | | |
|---|---|---|---|---|---|---|---|
| Route throw | 0 | 0 | 1 | 1 | 1 | 1 | 1 |
| Route clear | 0 | 1 | 0 | 1 | 1 | 0 | 0 |

TABLE 3

TMCC Switch Commands

| Switch Commands | Command field | | | Data Field | | | |
|---|---|---|---|---|---|---|---|
| Throw THROUGH | 0 | 0 | 0 | 0 | 0 | 0 | 0 |
| Throw OUT | 0 | 0 | 1 | 1 | 1 | 1 | 1 |
| Set address | 0 | 1 | 0 | 1 | 0 | 1 | 1 |
| Assign to route THROUGH | 1 | 0 | 0 | 0 | 0 | 0 | 0 |
| Assign to route OUT | 1 | 1 | 0 | 0 | 0 | 0 | 0 |

TABLE 4

TMCC Accessory Action Commands

| Accessory action commands | Command field | | | Data Field | | | |
|---|---|---|---|---|---|---|---|
| AUX1 off | 0 | 0 | 0 | 1 | 0 | 0 | 0 |
| AUX1 option 1 | 0 | 0 | 0 | 1 | 0 | 0 | 1 |
| AUX1 option 2 | 0 | 0 | 0 | 1 | 0 | 1 | 0 |
| AUX1 on | 0 | 0 | 0 | 1 | 0 | 1 | 1 |
| AUX2 off | 0 | 0 | 0 | 1 | 1 | 0 | 0 |
| AUX2 option 1 | 0 | 0 | 0 | 1 | 1 | 0 | 1 |
| AUX2 option 2 | 0 | 0 | 0 | 1 | 1 | 1 | 0 |
| AUX2 on | 0 | 0 | 0 | 1 | 0 | 1 | 1 |
| Numeric command | 0 | 0 | 1 | 0 | 0 | 0 | 0 |

Still referring to the prior art of FIG. 2A, the MTH DCS features two required components, the DCS Remote Control 102 and the Track Interface Unit (TIU) 104. An additional component, the Accessory Interface Unit (AIU) 112, can be added to provide control over the accessories and switches. The DCS operates by transmitting an electrical "digital" signal superimposed upon the power from the transformer 106 into the center rail 126 of the railroads track 128.

The MTH DCS controls switches and accessories by means of one or more AIUs 112. The AIU 112 receives its commands from the TIU 104 and supplies relay contact closure outputs to accessories and switches. One interface protocol between the TIU 104 and the AIU 112 is defined in U.S. Pat. No. 6,457,681, issued to Wolf et al. in October 2002 and incorporated herein by reference in its entirety. The disclosed interface consists of a three-wire serial interface port 134, wherein one wire is a data line that is set to the value of the most significant bit of the data byte being sent. A clock line is then pulsed high then low to clock in the signal into an 8-bit shift register in the AIU. After 8 bits have been clocked in, the entire byte is clocked out by pulsing the third line, which is a latch. The data in the byte is therefore essentially 7 bits of address to select the particular relay in the AIU that the user wishes to open or close and 1 bit to either open or close the relay.

As previously discussed, MTH DCS has the capability, by means of the TIU/TMCC serial cable 206, to permit a MTH DCS wireless remote to command TMCC equipped engines.

Now referring to FIG. 1, the first embodiment of the Model Train Controller Interface 100 acts as a bridge between MTH and TMCC components. As shown in FIG. 1, the interface 100 includes a plurality of digital ports connected to circuitry 136. Port J1, is connected to port 130 on the TIU 104 by means of a standard 9-pin serial null model cable and receives therefrom a first digital data stream 141 formatted in the TMCC protocol. A second port J2 connects to port 134 on the TIU 104 and receives therefrom a second digital signal 142 in a second protocol that would normally be received by an AIU. A third port J3 may be connected to command generating devices such as the ARC 114 from which the interface 100 receives a third digital signal 143. A fourth port J4 connects to port 132 on the TMCC command base 108 by means of a standard 9-pin male-to-male null modem cable. Port J4 is bidirectional, transmitting a fourth digital signal 144 in TMCC protocol on pin 2 to the TMCC command base 108 and receiving back a fifth digital signal 145 from the command base 108 on pin 3. This fifth signal 145 is transmitted as signal 146 on port J3, to device controllers 114–120. Power is supplied to the device by means of a pair of wires 148 wired to the transformer 106. Signal ground 150 is received from the TMCC command base 108 on pin 5 of J4 and is passed along on lead 152 to device controllers 114–120.

Figure 3:
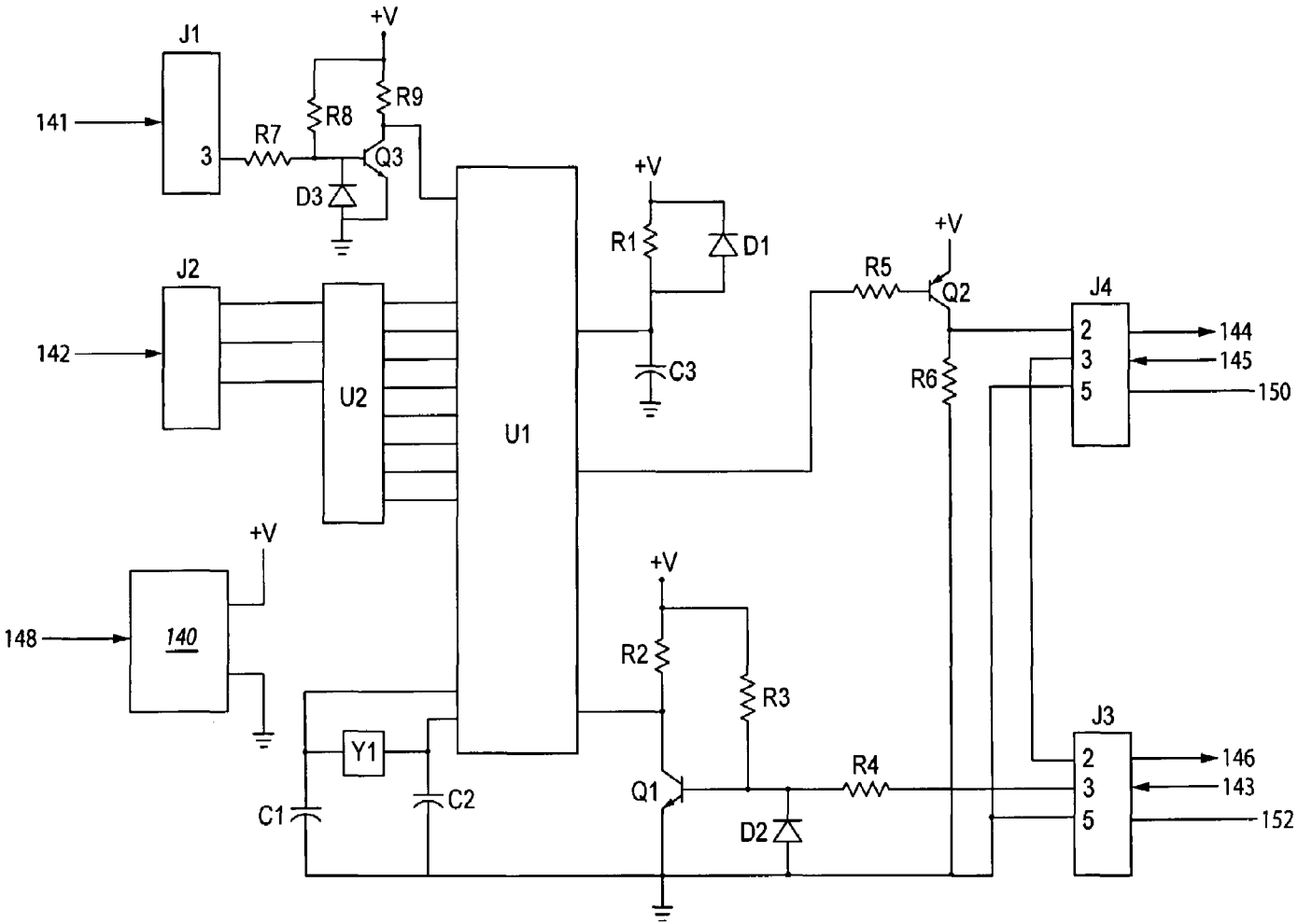
FIG. 3 is a representative schematic of the model train controller interface device according to the present invention.

FIG. 3 is a representative schematic of the circuit 136 mounted within the housing of the interface 100. The electronic circuit controls the flow of digital data between the TIU 104, the TMCC command base 108, and TMCC devices 114–120. The circuitry includes a microcontroller U1 with built in memory, discrete electronic devices, and program instruction code stored within the memory. The firmware stored in the memory controls the multiplexing of the various data streams and is of a level of complexity known to those skilled in the art of programming.

In operation, the interface 100 transmits commands received on ports J1–J3 to the TMCC command base 108. For instance, engine commands in data stream 141, originating from the MTH DCS handheld remote 102, are received by the TIU 104 and are transmitted on port 130 through a standard commercially available serial cable to port J1. Switch and accessory commands generated from the MTH DCS handheld remote 102, are relayed through port 134 on the TIU 104, and are received in data stream 142 on port J2. The signal is read by shift register U2 and after 8 bits have been clocked in, the entire byte is clocked into U1. Finally, pin 3 on port J3 receives digital data stream 143, a third source of command data from any ARC 114 or other automated device that generates TMCC commands intended for TMCC controlled components.

Still referring to FIG. 3, engine and accessory commands received in data streams 141–143 on ports J1–J3 respectively are processed by circuitry shown in FIG. 3 and are read by microcontroller U1. The microcontroller U1 reads the data stream presented by the three digital input streams, converting the data received to the TMCC protocol disclosed in Tables 1–4 as necessary. The microcontroller multiplexes the data and outputs a data stream which is processed by R5, R6 and Q2 into a digital data stream 144 on pin 2 of port J4 to port 132 of the TMCC command base 108. Upon receipt of the data stream transmitted from port J4 pin 2, the TMCC command base 108 transmits engine commands to a model train engine (not shown) via Frequency Modulation (FM).

Without the present invention 100, switch and accessory commands from the TMCC command base 108, would normally, as shown in FIG. 2A, be contained in transmit signal 145 wired directly to controllers 114–120 through port 132. Use of the present invention 100, however, requires that port 132 be wired to J4 of the interface 100. Therefore, since the TMCC command base 108 has only one port 132, the transmit lead of the command base 108 must route the data stream 145 back to J4 pin 3 of interface 100. Data stream 145 is then transmitted on pin 2 of J3 to the receive port of the daisy-chained device controllers 114-120 via data stream 146 as shown in FIG. 1.

A rectifier circuit 140, known to those skilled in the art converts the AC signal from the transformer 106 to the DC voltage required by the present invention 100.

The microcontroller U1 is a commonly available commercial device, such as the PIC17C42A or the newer PIC18F4220, and is typically found with an oscillator circuit formed by C1, C2 and crystal Y1. Similarly, a power on reset function is provided by R1, C3 and D1.

Table 5 provides representative values for components disclosed in FIG. 3 and is based upon known interfaces for the various model train components and the design preferences of those skilled in the art of electronic design.

TABLE 5

Representative Component Values

| Reference Number | Component | Value |
|---|---|---|
| U1 | Microcontroller | PIC17C42A |
| U2 | Shift Register | 74HCT164 |
| Y2 | Crystal Oscillator | 32 Mhz. |
| C1 | Capacitor | 33 uF |
| C2 | Capacitor | 33 uF |
| C3 | Capacitor | 0.1 uF |
| Q1 | Transistor | 2N3904 |
| Q2 | Transistor | 2N3906 |
| Q3 | Transistor | 2N3904 |
| D1 | Diode | 1N914 |
| D2 | Diode | 1N914 |
| D3 | Diode | 1N914 |
| R1 | Resistor | 100K |
| R2 | Resistor | 100K |
| R3 | Resistor | 100K |
| R4 | Resistor | 100K |
| R5 | Resistor | 100K |
| R6 | Resistor | 100K |
| R7 | Resistor | 100K |
| R8 | Resistor | 100K |
| R9 | Resistor | 100K |

Figure 4:
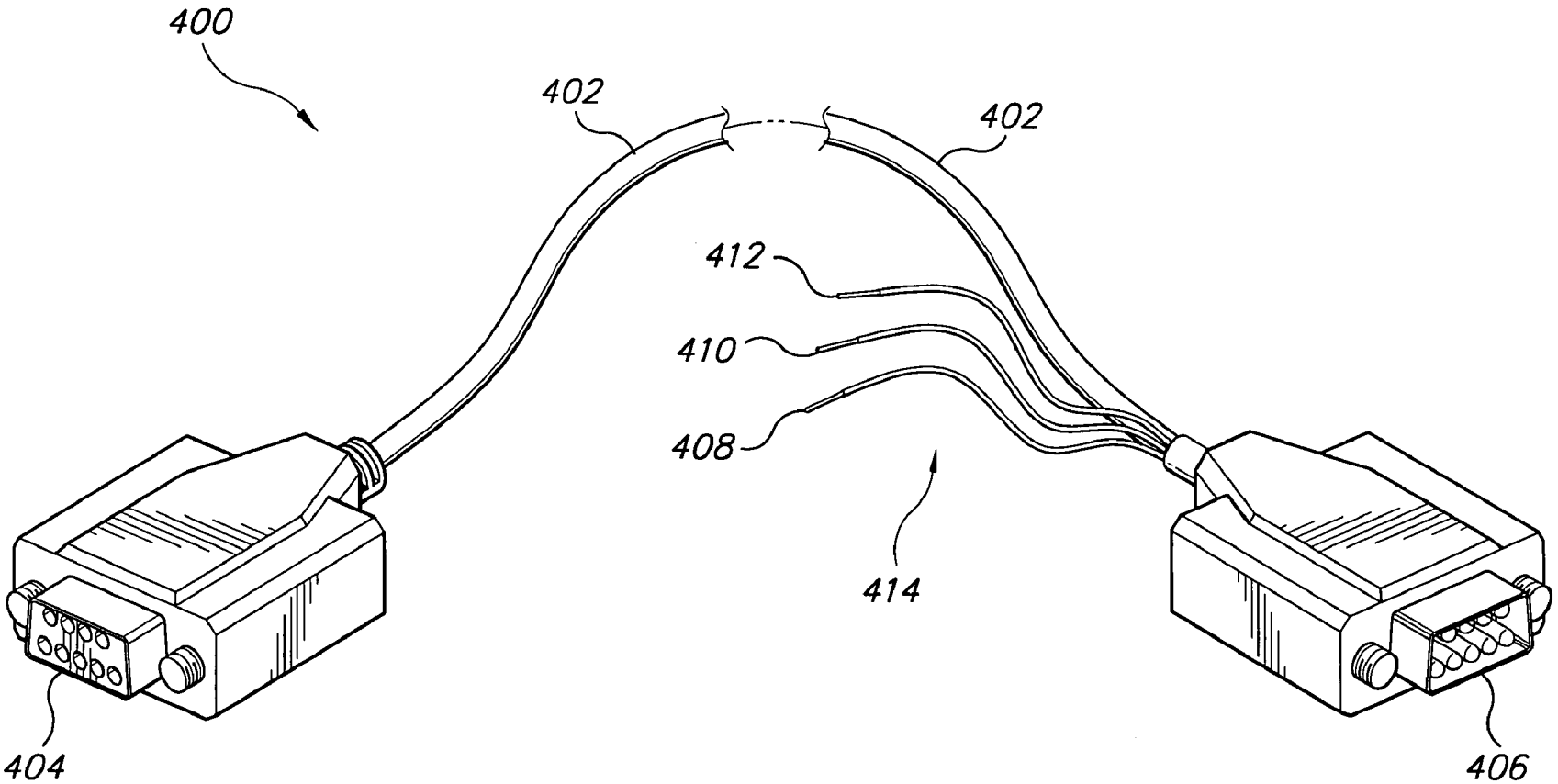
FIG. 4 is a perspective view of a second embodiment of the present invention comprising a cable having male and female connectors and pigtail leads.

FIG. 4 illustrates a second embodiment of the present invention in which a specially designed interface cable 400 retains the ability of the CAB-1 110 remote to command TMCC equipped switch and accessory device controllers 116–120 while permitting the MTH DCS remote 102 to command TMCC equipped engines.

Interface cable 400 comprises a cable 402 having at least two electrical conductors connected between two commercially available 9-pin "D" shell connectors 404, 406, one connector 406 is a 9-pin male connector and the other a 9-pin female connector 404. The interface cable 400 is similar to a commercially available "null modem" cable in that pin 2 of one connector is wired to pin 3 of the connector at the other end. Signal ground is transmitted though pin 5 on both connectors. Although the TMCC does not presently send commands to the TIU and therefore would not require a transmit lead from the TMCC to the TIU, this lead is made available for future use.

Figure 5:
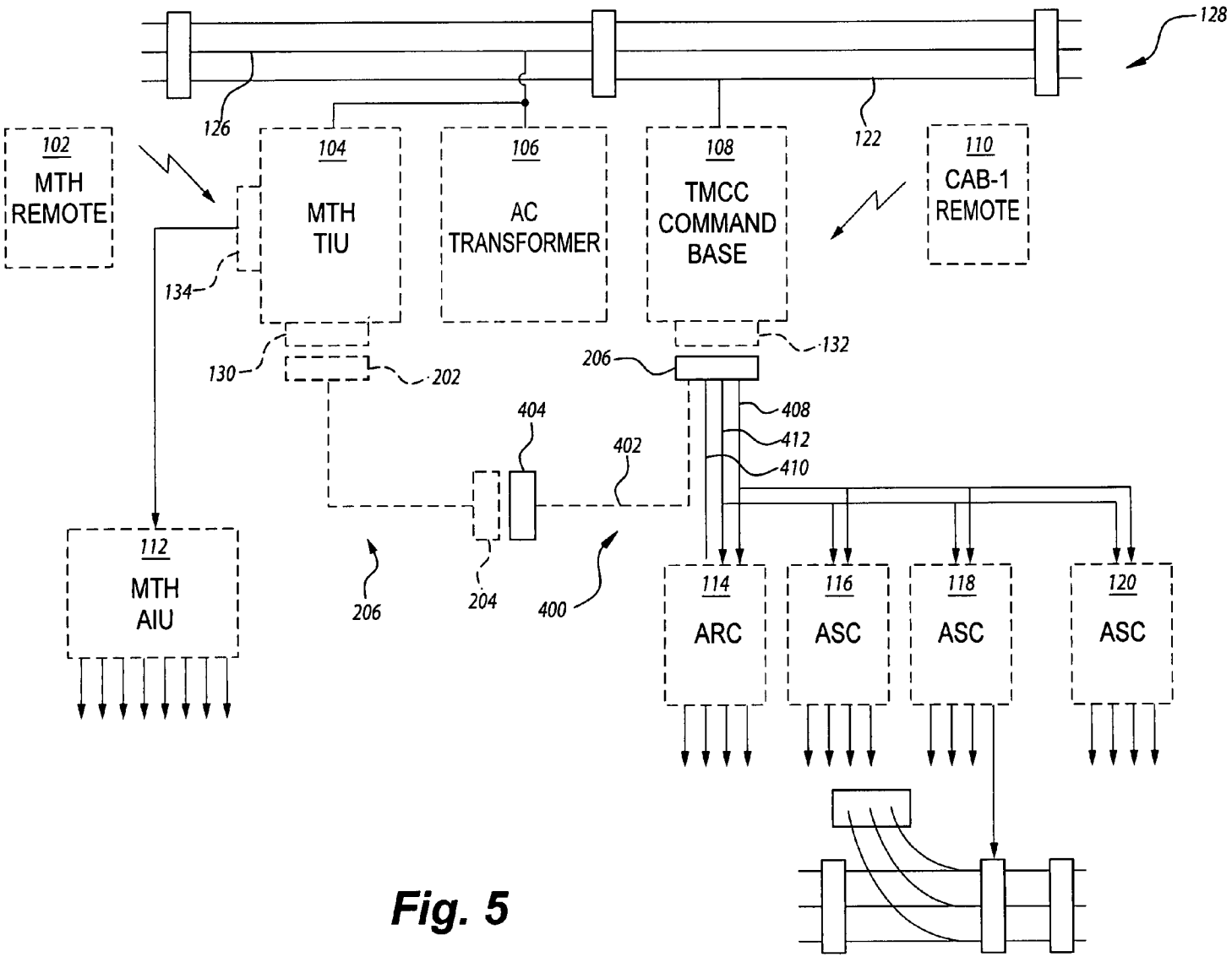
FIG. 5 is a block diagram illustrating the second embodiment according to FIG. 4 integrated in a model train track layout.

FIG. 5 illustrates the interconnection of interface cable 400 within the model train layout. Male connector 406 is adapted for mounting to port 132 of the TMCC command base 108, and female connector 404 is connected to the male connector 204 of the MTH/TIU serial cable 206. Unlike standard "null modem" cables, the cable converter 400 includes a pigtail 414 comprising three conductors 408–412 extending from a connector, the three conductors 408–412 being in electrical contact with pins 2,3, and 5 of connector 406 respectively. Although the pigtail 414 may extend from connector 404, in the present design, pigtail 414 extends from connector 406 and conductors 408–120 are soldered or crimped to pins 2,3 and 5 of connector 406 respectively. The end of wire 408 is connected by a tightening screw connector to the receive terminal of the first device controller 114 and is the means by which commands are transmitted from the TMCC command base 108 to device controllers 114–120. The end of wire 410 is screwed on to the transmit terminal of any transmitting device controller 114 and transmits commands back to the TMCC command base 108. Wire 412 carries signal ground from the command base 108 to device controllers 114–120.

Figure 6:
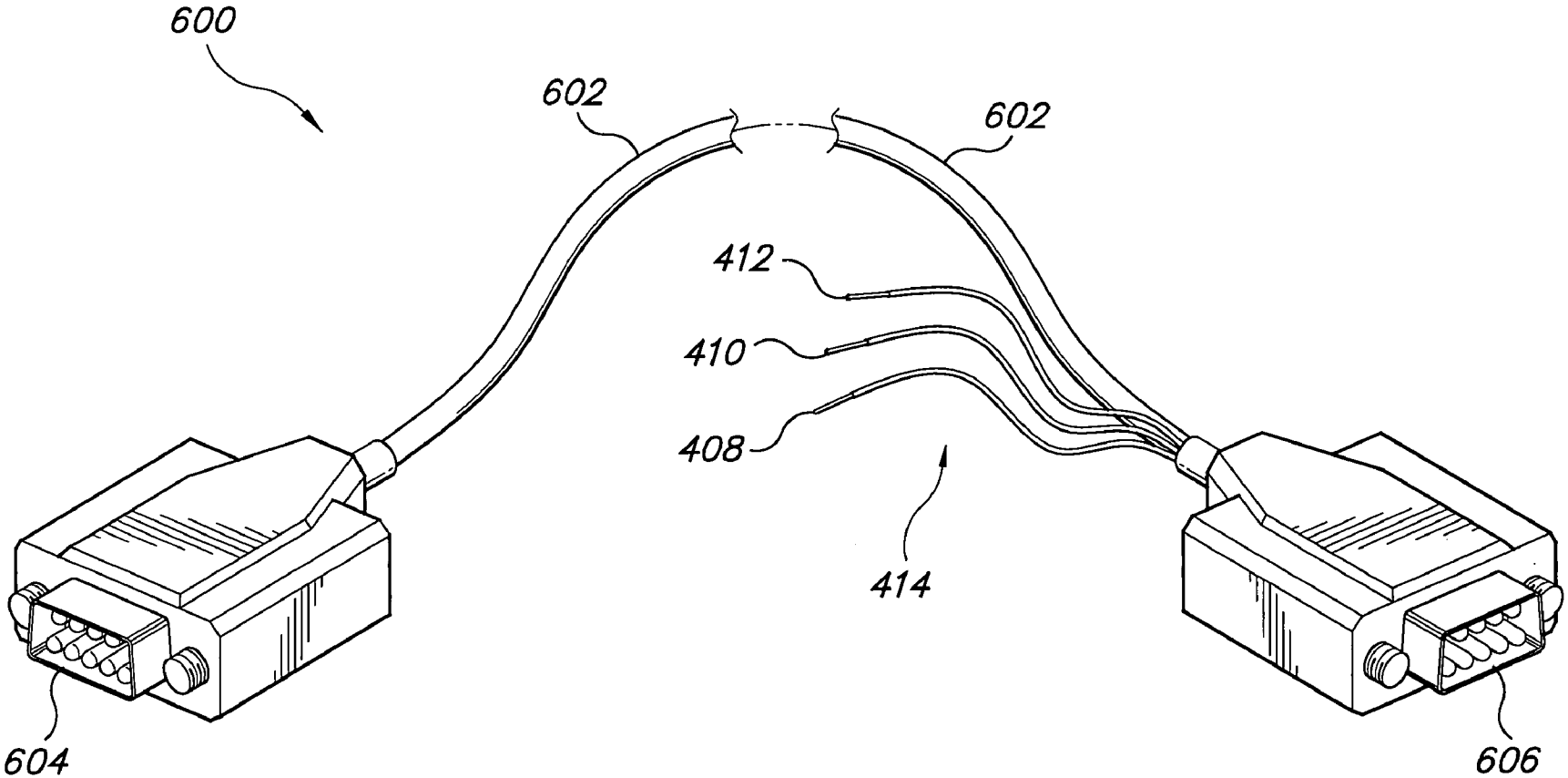
FIG. 6 is a perspective view of a third embodiment of the present invention comprising a cable having two male connectors and pigtail leads.
Figure 7:
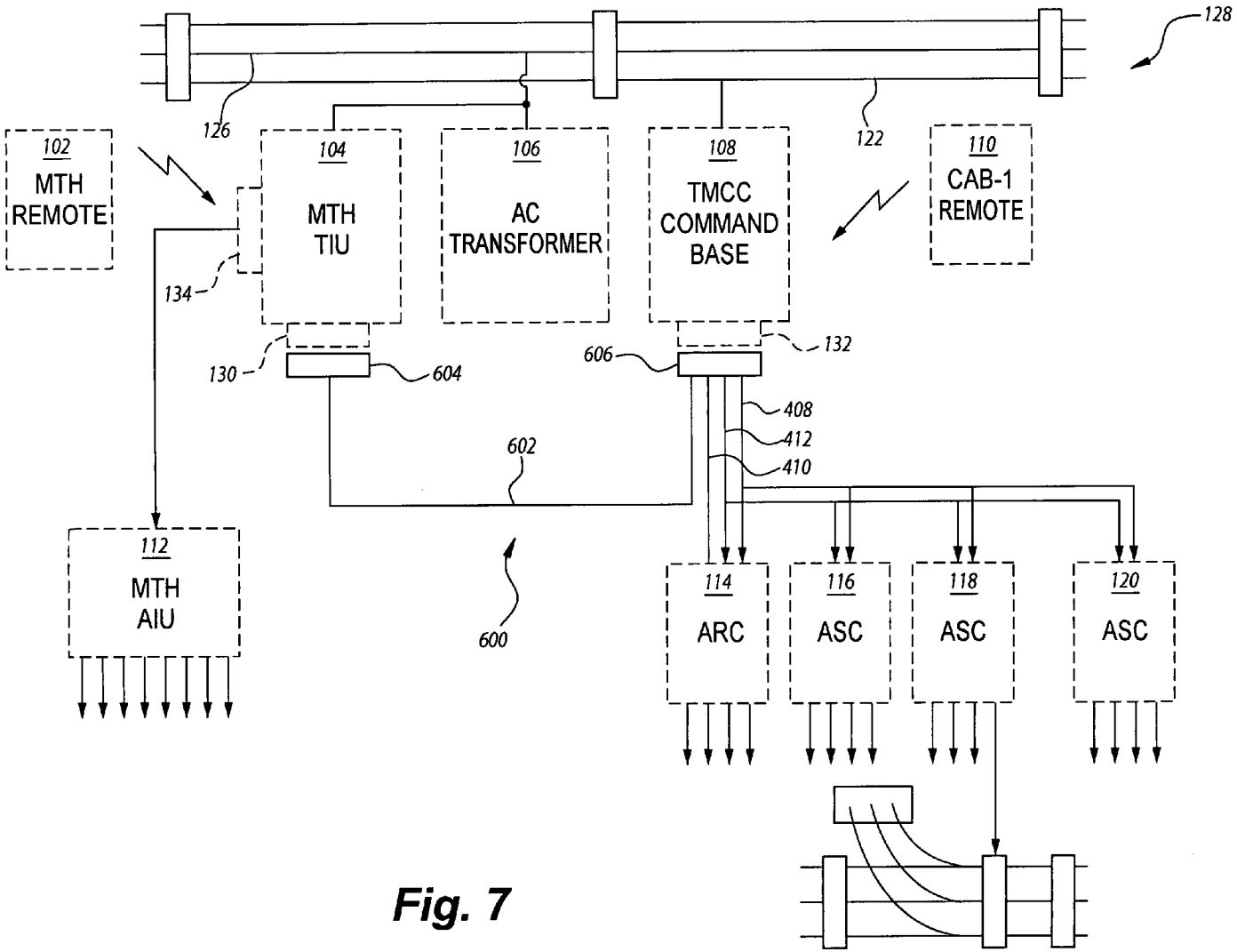
FIG. 7 is a block diagram illustrating the cable interface of the third embodiment according to FIG. 6 connected directly between the TIU and the TMCC command base.

A third embodiment 600, similar to the cable converter disclosed in FIGS. 4–5, is illustrated in FIG. 6. Similar to the embodiment 400, interface cable 600 is designed to replace the need of the MTH TIU/TMCC serial cable 206 shown in FIG. 5. As best illustrated in FIG. 7, connector 604 engages port 130 of the TIU 104, and connector 606 engages port 132 of TMCC command base 108. The interface cable 600 differs from embodiment 400 shown in FIG. 4, in that interface cable 600 has male connectors 404, 406 on both ends of cable 602 and pin 3 of connector 406 is wired to pin 9 of connector 404, for unlike standard practice, the TIU transmits on pin 9 instead of pin 2.

Still referring to FIGS. 6–7, interface cable 600 is similar to the cable interface disclosed as embodiment 400, in that pigtail 414 and conductors 408–412 extend from pins 2,3 and 5 of connector 606 and are connected to device controllers 114–120.

It is to be understood that the present invention is not limited to the embodiment described above, but encompasses any and all embodiments within the scope of the following claims.

I claim:

1. A model train controller interface and protocol converter, comprising:

a housing;

at least one first command data port mounted in the housing adapted for being in electrical communication with a first command base;

a second command data port mounted in the housing adapted for being in electrical communication with a second command base;

a controller data port mounted in the housing adapted for being in electrical communication with at least one device controller; and a printed circuit board disposed within said housing electrically connected to the plurality of data ports, the circuit board having an interface electronic circuit mounted thereon, the circuit including a microcontroller with onboard memory, and computer readable program code stored in the memory, the code including means for converting, combining, and transmitting a first and second command signals received from the first command base in at least one protocol to a third control signal in a protocol determined by the second command base, and means for receiving a fourth command signal from the second command base and transmitting the fourth command signal to at least one device controller.

2. The model train control system interface device according to claim 1, wherein the plurality data ports includes:

a first port receiving a digital data stream in a first communication protocol from the first command base;

a second port receiving a second digital data stream in a second communication protocol from the first command base;

a third port transmitting a third digital data stream in the first communication protocol to the second command base;

wherein the third port has a transmit lead and a receive lead.

3. The model train control system interface device according to claim 2, wherein the second port comprises a three-wire serial interface.

4. The model train control system interface device according to claim 2, wherein:

the third port receives a fourth digital data stream in the first communication protocol from the second command base;

a fourth port transmitting a fifth digital data stream in the first communication protocol to the at least one device controller, and receiving from the at least one device controller a sixth data stream formatted in the first communication protocol.

5. The model train controller interface device according to claim 2, wherein the first communication protocol is a three-byte format.

6. A method for converting model train and accessory commands of a first command base to a protocol discernable by a second command base, comprising the steps of:

providing a model train interface circuit having a plurality of digital ports adapted to electrically communicate with:

a first model train command base;

a second model train command base; and at least one model train device controller;

receiving model train address and command data formatted in at least one data protocol from the first model train command base;

translating the data received from the first model train command base to a protocol discernable by a second model train command base;

outputting the transformed data to the second model train command base; and receiving model train address and command data from the second model train command base and forwarding the data received from the second model train command base to model train device controllers.

* * * * *